US006279750B1

(12) United States Patent
Lohmann

(10) Patent No.: US 6,279,750 B1
(45) Date of Patent: Aug. 28, 2001

(54) METHOD AND DEVICE FOR DISTRIBUTING MAIL ITEMS

(75) Inventor: Boris Lohmann, Bremen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/308,616

(22) PCT Filed: Nov. 7, 1997

(86) PCT No.: PCT/DE97/02592

§ 371 Date: Jul. 23, 1999

§ 102(e) Date: Jul. 23, 1999

(87) PCT Pub. No.: WO98/22228

PCT Pub. Date: May 28, 1998

(30) Foreign Application Priority Data

Nov. 20, 1996 (DE) ..... 196 47 973

(51) Int. Cl.[7] ..... B07C 5/00

(52) U.S. Cl. ..... 209/559; 209/547; 209/552; 209/584; 209/659; 700/224; 700/226

(58) Field of Search ..... 209/584, 547, 209/552, 559, 659, 583, 900; 700/223, 224, 225, 226, 227, 228, 229; 705/400, 401, 402, 403, 404, 405, 406, 407, 408, 409, 410

(56) References Cited

U.S. PATENT DOCUMENTS 5,363,971 11/1994 Weeks et al. ..... 209/584

FOREIGN PATENT DOCUMENTS

| | | |
|---|---|---|
| 4302231A1 | 8/1994 | (DE) . |
| 69208789T2 | 3/1996 | (DE) . |
| 19528803C1 | 1/1997 | (DE) . |
| 0661106A2 | 7/1995 | (EP) . |
| 0718049A2 | 6/1996 | (EP) . |
| WO93/02810 | 2/1993 | (WO) . |

*Primary Examiner*—Donald P. Walsh
*Assistant Examiner*—M. Beauchaine
(74) *Attorney, Agent, or Firm*—Venable; Robert Kinberg

(57) ABSTRACT

The invention relates to the distribution of mail items with information on the surface of the mail items. Distribution occurs successively by means of various sorting machines. Sorting in particular is carried out in a succession of operations for the last point of distribution. According to the invention, distribution points are determined once the mail items have been received in the first sorting machine and the thicknesses of the mail items are measured by optical scanning of the mail item surfaces. Mail item thicknesses allocated to the distribution points are registered, stored and statistically prepared if required. Optimized sort programs are then calculated for sorting machines assigned to the various distribution points based on information regarding thickness, and the mail items are distributed accordingly. The optimized sort programs and data on determined thickness alone can be transmitted to the sorting machines assigned to the various distribution points so that the subsequent sort program can be drawn up.

9 Claims, 3 Drawing Sheets

METHOD AND DEVICE FOR DISTRIBUTING MAIL ITEMS

BACKGROUND OF THE INVENTION

The invention relates to the distribution of mail items whose surfaces are provided with distribution information. The distribution is effected successively with the aid of various sorting machines, particularly through successive sorting operations for the final distribution point.

In the sorting of mail items in sorting machines (e.g. letter-sorting machines, large-item-sorting machines) a separating station is normally provided for each sorting direction. If the number of mail items to be sorted exceeds the capacity of the stacker, bin or container at the separation station, the container is automatically or manually exchanged or emptied.

In certain situations, however, it can be beneficial or even necessary to flexibly adapt the sorting plan to the number of items to be sorted and the space the items occupy.

If certain sorting directions are especially heavily frequented, it is advantageous to provide numerous sorting compartments or containers for these directions, which are emptied in such a way that the sorting compartments are emptied as infrequently as possible due to the use of fullness of capacity indicators (DE 195 28 803 A1).

If a successive sorting is to be performed, a uniform loading of the sorting compartments can reduce the number of necessary sorting compartments or sorting operations. Because mail items make two or more passes through machines during successive sorting and the sequence of the re-supply of mail items into the machines must be strictly adhered to, it is particularly desirable in terms of mail item handling for the mail-item flow from any separation station not to exceed a certain amount of space. In automatic successive sorting machines, this requirement is even compulsory because the machine must store the entire volume of items internally during and between sorting passes; the space is therefore apparently limited.

To this point, the operator's experience or quantity statistics of past daily mail-item volumes has or have been used in the generation of sorting plans.

The disadvantage of this procedure is that no dynamic adaptation to the mail-item volume that is actually present is effected.

Particularly in successive sorting, solutions have become known in which a quantity statistic is created (number of mail items per distribution point) after the recording of addresses. Based on this statistic the following sorting operations can be optimized with respect to space requirements (EP 0 533 536 B1 and U.S. Pat. No. 5,363,971). Based on the quantities of items, the optimization can only be effected imprecisely because the items have different thicknesses. For a more precise assessment of the space requirements of the mail items, EP 0 661 106 A2 and EP 0 718 049 A2 proposed to detect the item thicknesses with a suitable measuring device and use this information to optimize the later sorting operations.

A more serious disadvantage is that no sorting-plan optimization is possible in the first machine pass. In automatic successive-sorting machines, this can make sorting impossible, although a suitable structuring of the first sorting plan would make sorting possible.

BRIEF SUMMARY OF THE INVENTION

The problem addressed by the invention is to structure the distribution of the mail items in sorting compartments or containers in the sorting to distribution points prior to this sorting such that the items can be distributed as uniformly as possible to the sorting compartments or containers, avoiding overflow situations.

According to the invention, the object is accomplished by the measurement of the item thicknesses; the determination of the distribution points; the registration and storage of the thicknesses of items associated with the distribution points during the first reception of items; the calculation of optimized sorting plans for the sorting machines allocated to the respective distribution points taking into consideration data relating to the item thicknesses; and the corresponding sorting of the items satisfy the prerequisites for the distribution of the items relating to the object of the invention, knowledge about the present quantities of mail items and item thicknesses, relating to the distribution points, permits an optimized distribution before the first processing of these items in the sorting machines for the distribution points.

Advantageous embodiments of the invention are herein disclosed.

Hence, according to the prerequisites for control technology in the sorting machines, the optimized sorting plans are transmitted during the first reception of the items. In sorting machines associated with the distribution points, the data relating to the item thicknesses and data associated with the distribution points, are transmitted.

It, is advantageous to identify each item by transmitting its thickness, distribution point and an applied ID code.

It, is advantageous to perform the calculation of the optimized sorting plans centrally, and then transmit the sorting plans to the sorting machines, which saves resources.

In a further advantageous embodiment 5, only the number of mail items and the associated, statistically-determined item thicknesses are used as data relating to the item thickness for each distribution point.

The sorting plans are advantageously optimized such that the items are distributed to the sorting compartments of the respective sorting machine as uniformly as possible without the compartments being overfilled.

BRIEF DESCRIPTION OF THE DRAWINGS

The invention is described in detail below by way of embodiments.

DETAILED DESCRIPTION OF THE DRAWING

Figure 1:
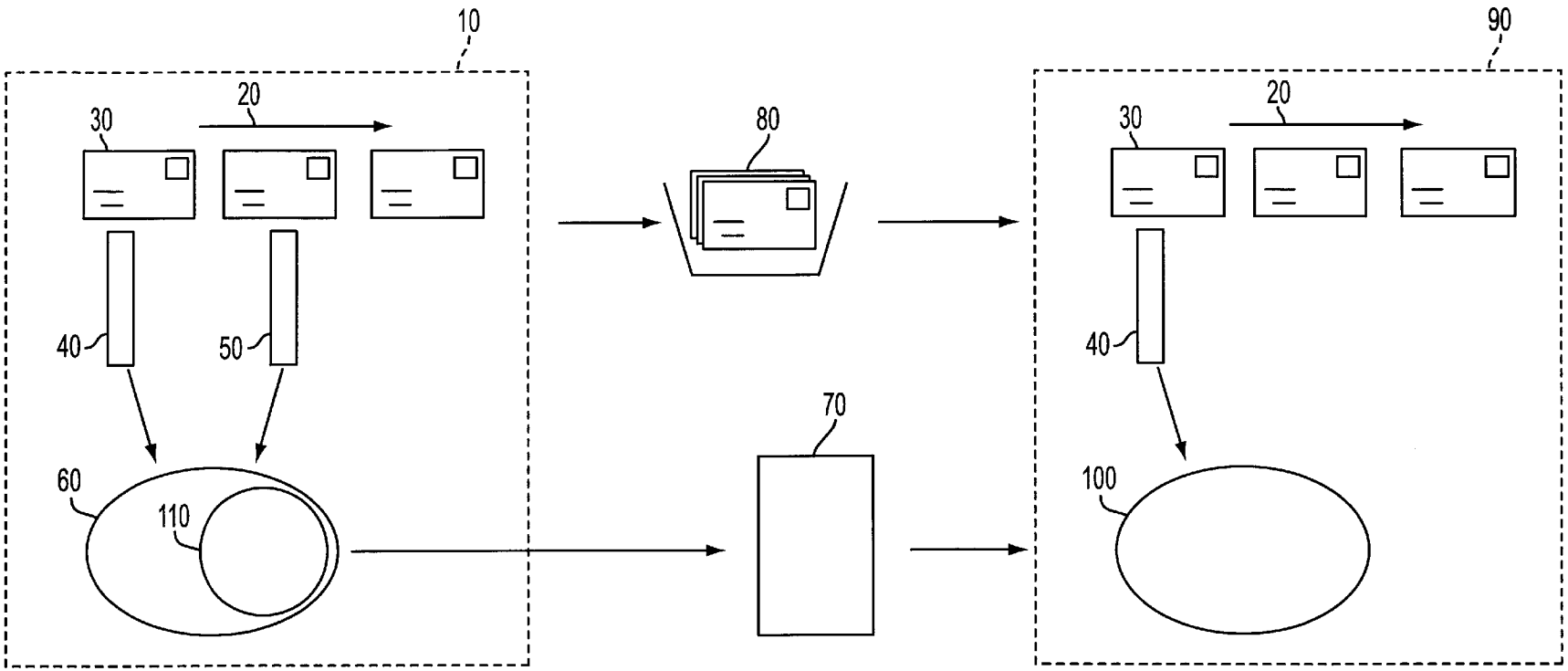
FIG. 1 illustrates a functional block representation of one embodiment of the present invention wherein an optimized sorting plan is created during the first reception of the item and then transmitted.

According to FIG. 1, during the first reception of mail items, the items 30 are scanned by optical measuring means 40 during their transport 20 in a sorting machine 10 to assess the sorting information located on the items 30. The item thicknesses are determined with the aid of further measuring means 50.

In the machine control 60, the sorting information for each mail item, such as sorting destination, an identification code (ID code) if needed, and the item thickness, is registered and possible statistically determined. Afterward, in a functional block 110 of the machine control 60, the optimized sorting plans for the downstream sorting machine 90 associated with the sorting points are calculated. The data relating to these sorting plans are transmitted to the machine control 100 of the relevant sorting machine 90 via a transmission medium 70. Data networks, transponders or diskettes can serve as a transmission medium 70.

The mail items 30 are transported in containers 80 to the sorting machine 90 for the respective distribution point.

During sorting in the sorting machines 90 designated for specific sorting destinations, the surfaces of the items 30 are likewise scanned with optical measuring means 40 for assessing the sorting information (sorting destination) for each item. The sorting is then effected with the aid of the transmitted, optimized sorting plan.

Figure 2:
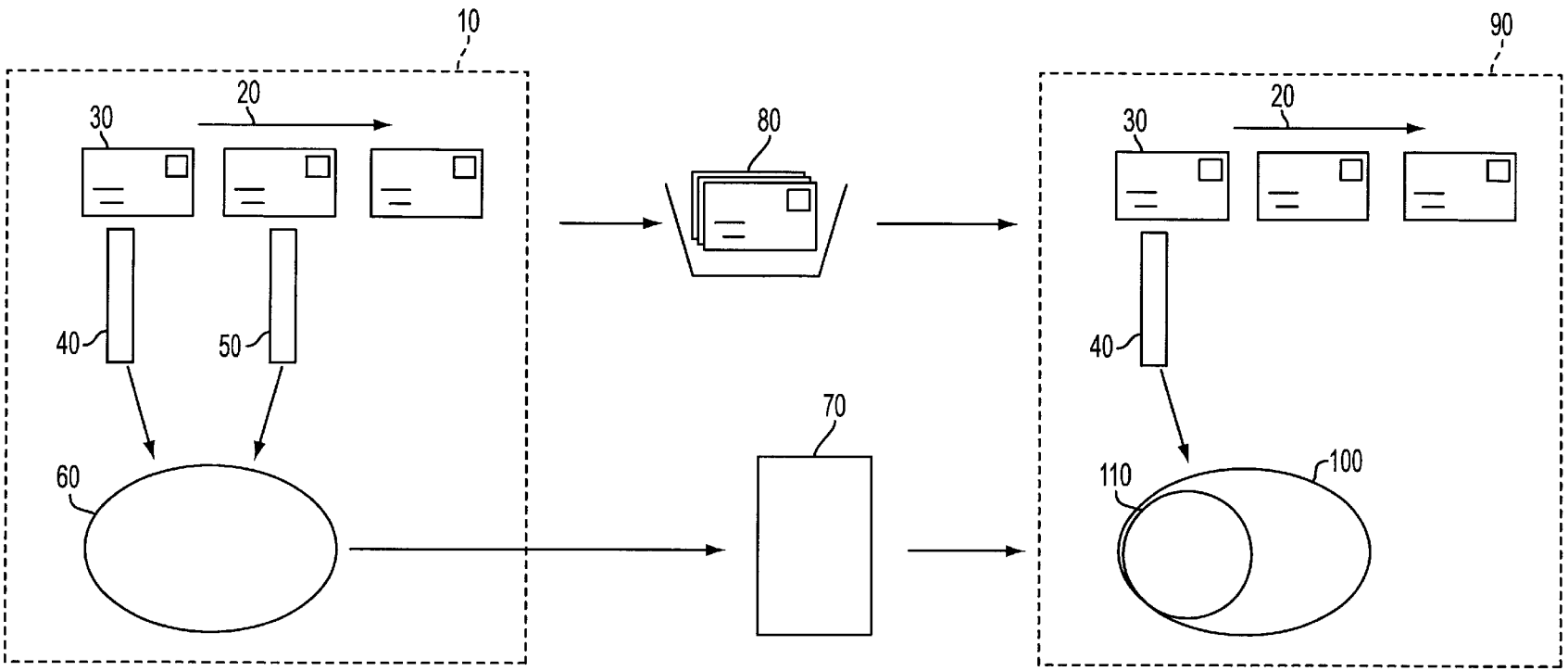
FIG. 2 illustrates a functional block representation of another embodiment of the present invention wherein the optimized sorting plans are created in the sorting machines associated with the distribution points.

Corresponding to FIG. 2, in the machine controls 60 of the sorting machines 10 that receive the items 30 for the first time, after the sorting information (sorting destinations) and the item thicknesses have been determined, this information is transmitted via the medium 70, with an identification code and following statistical determination, if necessary, to the machine controls 100 of the sorting machines 90 designated for the respective distribution points.

There, the optimized sorting plans, according to which the items 30 are sorted after their sorting destinations (distribution points) have been received, are calculated in a corresponding functional block 110.

Figure 3:
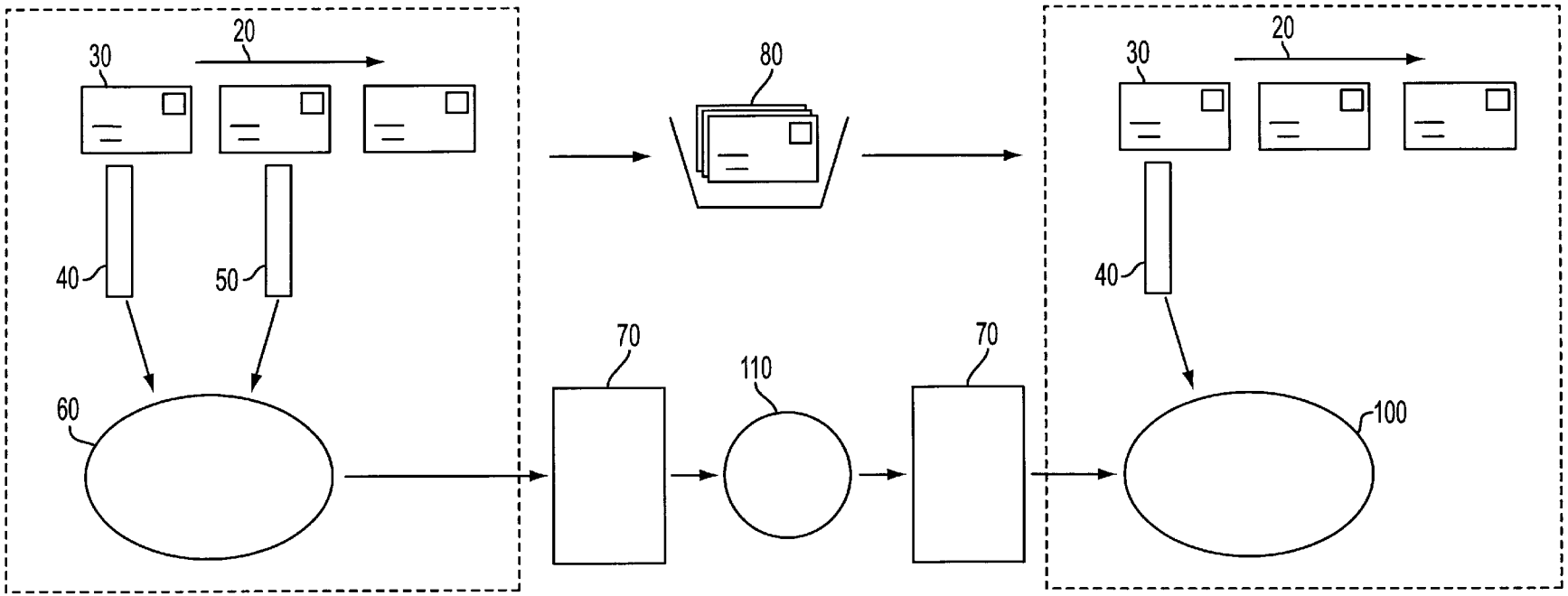
FIG. 3 illustrates a functional block representation of another embodiment of the present invention wherein the optimized sorting plans are created centrally.

As can be seen from FIG. 3, in large distribution systems, it can be more beneficial to transmit the item data (including thickness information) to a central processing unit 110, corresponding to the preceding examples, for determining the optimized sorting plans, from which point the optimized sorting plans are transmitted to the controls 100 of the downstream sorting machines.

The following tables illustrate possible structures of the transmitted or processed statistical data.

Tables 1 and 2 illustrate possible structures of the transmitted statistical data.

TABLE 1

| No. | Sorting Destination | Number of Mail Items | Average Item Thickness |
|---|---|---|---|
| 1 | 78459 | 120 | 2.3 |
| 2 | 78476 | 89 | 1.9 |
| 3 | 78498 | 132 | 3.0 |

IN Table 1, each sorting destination is identified by a five-digit number. Only the number of items and their average thickness (for each sorting destination) are transmitted.

TABLE 2

| No. | Sorting Destination | Number of Mail Items | Sequence of Item Thicknesses |
|---|---|---|---|
| 1 | 78459-123 | 5 | 2.3<br>1.6<br>1.0<br>4.1<br>2.1 |

TABLE 2-continued

| No. | Sorting Destination | Number of Mail Items | Sequence of Item Thicknesses |
|---|---|---|---|
| 2 | 78459-124 | 3 | 1.9<br>1.1<br>3.2 |
| 3 | 78560-100 | 2 | 2.1<br>2.2 |

In Table 2, each sorting destination is defined by an eight-digit number. For each sorting destination, the number of items and the sequence of item thicknesses are transmitted.

In Table 3, the mail items additionally bear or contain an identification code (ID code), which permits individual items to be unequivocally re-recognized. For each ID code, the destination information is recorded in the form of an eight-digit decimal number; the item thickness is also given.

TABLE 3

| ID code No. | Sorting Destination | Item Thickness |
|---|---|---|
| 01.01.97-1001 | 78459-123 | 2.3 |
| 01.01.97-1003 | 78959-128 | 1.9 |
| 01.01.97-1004 | 78560-100 | 2.1 |

Two examples are presented for optimizing the sorting plans:

EXAMPLE 1

A fine sorting of 10,000 mail items is effected in 250 directions through sorting in a machine having 300 compartments (e.g. an AEG fine-distribution machine). Thus, on average, each compartment is filled with 40 items. Because each compartment has a loading capacity of about 100 items, the machine need not be emptied during the sorting operation.

If it is known before the sorting (through the proposed transmission of previously-collected data) that, for example, 30 of the 250 directions are especially heavily frequented, with, for example, 160 items each as opposed to the average value of 40, the sorting plan can be modified prior to the start of sorting such that additional compartments are reserved for the 30 most heavily frequented directions, for a total of, for example, 250+30=280 of the 300 available compartments. The compartments designated for the same sorting directions can be adjacent to one another, so the machine can subsequently be emptied according to directions.

EXAMPLE 2

In successive sorting according to the "Radix sorting method," mail items pass through the sorting machine multiple times; in the process, the items are emptied after the first sorting operation and supplied to the machine again in the proper order for sorting. The "overflow" of individual compartments during the first sorting operation is especially disadvantageous, because reserve compartments must be resorted also. These compartments must be carefully brought into the proper sequence with the regular compartments after the later emptying in order to be supplied for the following sorting operation.

If, prior to the first sorting operation, previously-obtained information about item quantities and thicknesses reveals how much space must be provided for each sorting direction of the first sorting operation, the compartments can be allocated in a first sorting operation such that they are later emptied in the order of the particular sequence arrangement, and the items can be re-supplied to the machine for the further sorting operations. The same applies for the following sorting operations: When the item quantities and the required stack space for each sorting destination are known in advance, the sorting compartments can be allocated such that items for the same sorting destination are deposited into the same compartment, or at least into adjacent compartments.

What is claimed is:

1. A method of distributing a plurality of mail items whose surfaces are provided with distribution information, the method comprising the following steps:

a) scanning a surface of each of the plurality of items, determining a distribution point of each of the plurality of items, and measuring a thickness of each of the plurality of items, said scanning, determining, and measuring occurring in a first at least one sorting machine during a first reception of items;

b) registering and storing a first set of data comprising item data associated with the distribution points of each of the plurality of items, said registering and storing occurring during the first reception of items, and calculating sorting plans for a second at least one sorting machine using a second set of data comprising item data relating to the thickness of each of the plurality of items, the second at least one sorting machine designated for distribution points; and c) transporting each of the plurality of items to the second at least one sorting machine;

d) sorting each of the plurality of items to individual distribution points according to said sorting plans.

2. The method according to claim 1, wherein the step of calculating further includes calculating the sorting plans in controls of said first at least one sorting machine during the first reception of said plurality of items, and said sorting plans are transmitted to controls of the second at least one sorting machine.

3. The method according to claim 1, further comprising the step of transmitting the second set of data and the first set of data to the controls of the second at least one sorting machine, the controls of the second at least one sorting machine calculating said sorting plans.

4. The method according to claim 3, wherein the step of transmitting further includes transmitting data relating the distribution point for each of the plurality of items and an ID code of each of the plurality of items said ID code applied upon reception of the plurality of items.

5. The method according to claim 1, further comprising the steps of:

transmitting the second set of data and the first set of data to a central station for calculating the sorting plans for the second at least one sorting machine, and transmitting the sorting plans to the controls of the second at least one sorting machine.

6. The method according to claim 1, wherein the step of calculating further includes using a count of each of the plurality of items.

7. The method according to claim 1, further comprising the step of distributing the plurality of items approximately uniformly to sorting compartments, avoiding overflowing of the compartments.

8. An arrangement for distributing a plurality of mail items whose surfaces are provided with distribution information, the arrangement comprising:

a first at least one sorting machine for receiving said plurality of items;

a second at least one sorting machine associated with distribution points;

optical measuring means for assessing sorting information located on each of the plurality of items to determine a first set of data, said first set of data comprising data associated with distribution points of the plurality of items;

measuring means for ascertaining a thickness of each of a plurality of items;

said first at least one sorting machine including means for machine control for registering and storing a second set of data, said second set of data comprising data relating to the thickness of each of the plurality of items;

functional blocks for calculating sorting plans for the second at least one sorting machine using said second set of data;

transmission media for transmitting said first set of data and said second set of data to said functional blocks;

means for transporting the plurality of items from the first at least one sorting machine to the second at least one sorting machine.

9. The arrangement according to claim 8, wherein the means for machine control generates and outputs additional data relating the thickness of each of the plurality of items.

* * * * *